United States Patent [19]

Yeoman

[11] Patent Number: 4,493,956

[45] Date of Patent: Jan. 15, 1985

[54] IMPACT SWITCH

[76] Inventor: Richard E. Yeoman, 2125 Portola La., Westlake Village, Calif. 94014

[21] Appl. No.: 527,289

[22] Filed: Aug. 29, 1983

[51] Int. Cl.[3] ..... H01H 35/14; H01H 29/20

[52] U.S. Cl. ..... 200/61.47; 200/61.5; 200/220; 200/228

[58] Field of Search ..... 200/61.47, 61.5, 199, 200/209, 210, 220, 221, 228

[56] References Cited

U.S. PATENT DOCUMENTS 4,072,835 2/1978 Burke ..... 200/61.47

*Primary Examiner*—J. R. Scott

*Attorney, Agent, or Firm*—John J. Posta, Jr.

[57] ABSTRACT

A resettable impact switch is disclosed having a non-conductive body with a cavity therein. A pair of terminals extend from opposite sides of the body and have their reverse ends extending into the cavity. A pool of mercury is disposed in the cavity to electrically connect both terminals under normal operation. The pool of mercury is held in a contact-making position within the cavity by a plurality of concentrically disposed tubular members. Longitudinal, relative movement of the tubular members allows openings in their walls to be covered or uncovered to selectively position the mercury, thereby enabling opening or closing a circuit between the terminals. One cylindrical member is carried by a post member which is adjustable within the body. The post member also carries a second contact for making or breaking electrical contact between the terminals.

13 Claims, 5 Drawing Figures

IMPACT SWITCH

FIELD OF THE INVENTION

The present invention generally relates to inertia or impact-type switches which are opened upon being exposed to a pre-determined level of impact force.

BACKGROUND OF THE INVENTION

Department of Transportation statistics indicate that fires are one of the major causes of fatalities in automobile accidents. In turn, a major cause of such fires is shorted electrical circuits in the automobile, causing sparks which ignite gasoline vapors. A shorted automobile battery, as where sheet metal is forced against both battery terminals during a collision, is a frequent cause of such fires, because the high current available from such devices facilitates sparking. Thus, a need has existed for a device suitable for prevention of battery shorts. Further, since gasoline vapors may permeate a vehicle following a collision or other accident, a device suitable for preventing electrical shorts elsewhere in the vehicle has been needed.

PRIOR ART

There are many types of inertia/impact switch which generally provide for opening of a circuit when a predetermined unsettling force is applied thereto. One means, well-known in the art, for disconnecting an electrical circuit is a mercury tip switch, which typically comprises a reservoir of mercury disposed between two electrical contacts. When the circuit is to be completed, i.e., the switch closed, the switch is tipped so that a gap exists between the mercury and at least one of the contacts. The difficulty with such tip switches in preventing sparking during automotive impact or roll over is that the switch may open for a moment but then return to the closed condition. Such a return to the closed condition would render the switch valueless since electrical sparking, and therefore fires, could be started when the switch returned to the closed position. Also, such tip switches typically have not been capable of carrying the currents required of a car battery during starting and other operations.

Another switch is disclosed in U.S. Pat. No. 4,072,835, which issued on Feb. 7, 1978 to Courtney L. Burke, entitled "Fluid Type Inertia Switch Having Resettable Plunger and Cone Shaped Retainer". Such switches have been found to be rather complicated, insufficiently reliable, relatively difficult to manufacture and assemble, and incapable of satisfying the specific needs of particular applications.

Accordingly, it would be desirable to provide an improved type of impact switch which could be easily placed in an automotive electrical circuit, which would provide for opening of the circuit upon being exposed to a predetermined impact, capable of being easily reset, allow alternative manual breaking of the circuit and resetting thereof as for example to prevent theft of an automobile. The switch should have a minimum of parts which positively cooperate in a simple manner allowing ease of manufacture and assembly. These requirements are satisfied by applicant's invention.

SUMMARY OF THE INVENTION

The impact switch is substantially as described in the Abstract above. The present invention is a sophisticated mercury tip switch which opens and remains open upon impact by preventing the mercury from returning to its orginal position. The switch can be easily reset so as to close the circuit again. Further, a separable second contact is provided which can be opened to open up the switch while the mercury tip switch is still connected. This latter means of opening the circuit might be employed as an auto-theft device.

More specifically, the invention comprises a housing having a cavity therein with upper and lower openings in the housing. The lower opening has a terminal disposed therein in electrical contact with a pool of mercury disposed in the lower end of said cavity. A conducting member extends vertically within the cavity and has one end normally disposed in and in electrically contact with the pool which the opposite end is electrically normally connected to a second terminal secured to the housing. Means are provided to open and close the connection between the upper end of the connector and the second terminal.

A plurality of concentrically disposed, cylindrical members are disposed in the cavity and are so designed as to cooperatively control the movement of the pool of mercury about and within the cavity.

Upon impact, the mercury is displaced within the cavity so as to break the electrical connection between the conductor and the first terminal. The shape of the lower cylindrical member prevents the return of the mercury to it's initial position, but such return can be enabled by adjustment of the other cylindrical members thereby resetting the switch.

The device has ready and useful application in auto electrical systems. For example, it can be included in the electrical system to de-activate the circuit when the auto is involved in an accident. After opening of the circuit, it can readily be closed by a simple adjustment. The switch also enable one, by a simple operation, to break the upper contact of the conductor, thereby opening the circuit and preventing theft of the automobile when left unattended.

One object of the invention is to provide a simple yet reliable and effective impact switch.

Another object of the invention is to provide an impact switch which remains open after impact unless and until the switch is reset.

A further object of the invention is to provide an impact switch having a novel auto theft-preventing settable contact.

Further objects and features are set forth in the following detailed description and accompanying drawings.

DETAILED DESCRIPTION OF A PREFERRED EMBODIMENT

Figure 1:
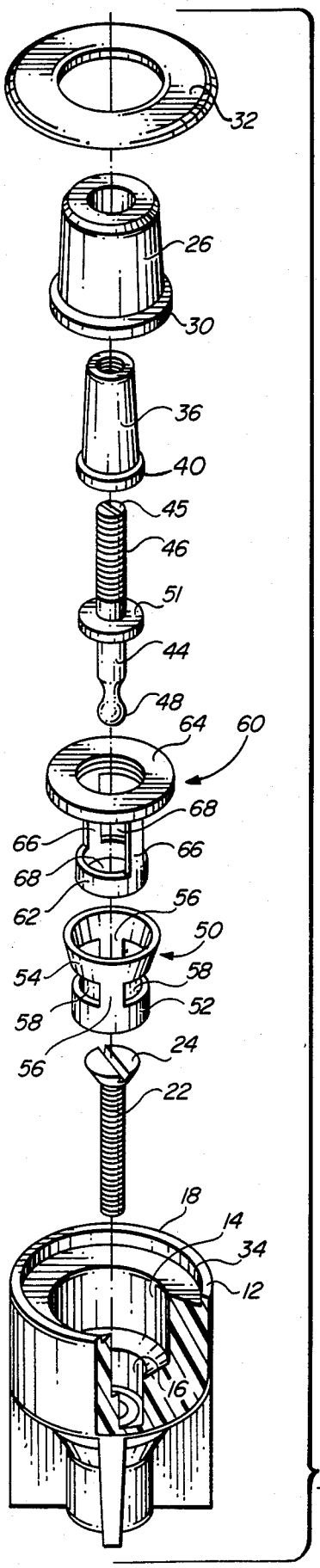
FIG. 1 illustrates an exploded view of the switch.
Figure 2:
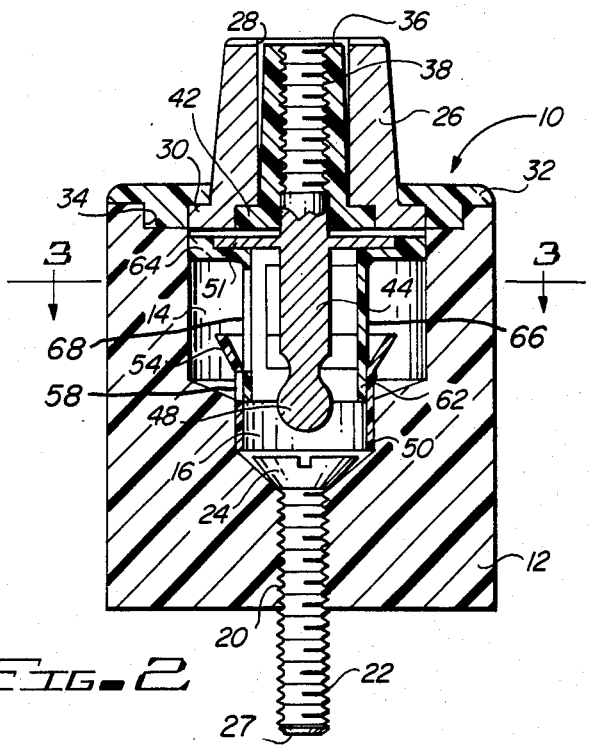
FIG. 2 illustrates a cross-sectional side view of the assembled switch and its theft prevention feature.
Figure 3:
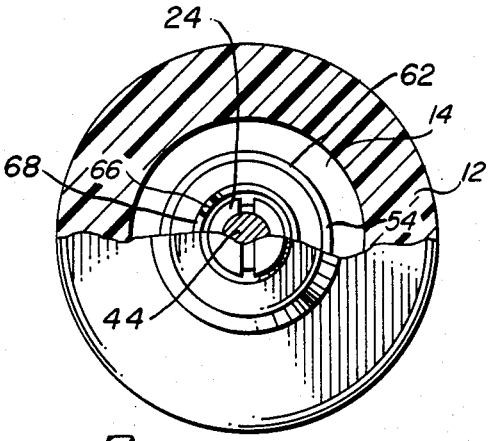
FIG. 3 is a cross-sectional view of the switch taken along lines 3—3 of FIG. 2.

Now referring more particularly to FIGS. 1–3, a preferred embodiment of the invention is shown. Thus, a switch 10 is provided which is comprised of a non-conductive housing 12 having a cavity 14 therein along with a well 16 formed therein at the lower end of cavity 14. Housing 12 has an upper opening 18 and threaded lower opening 20 disposed therein enabling communication of cavity 14 with the area outside housing 12. Terminal 22 is threaded in opening 20 and has its head 24 extending into well 16 and its lower end 27 extending outward from housing 12 to enable connection to external wiring (not shown).

Top terminal 26 has a longitudinal opening 28 extending therethrough and a radially extending contact 30 integral therewith at the lower end thereof. Non-conducting cap 32 is disposed about terminal 26 and secured thereto by adhesive or other means. The cap 32 is adapted to be received in stepped recess 34 in housing 12 and secured therein by appropriate adhesive means, or by wedging therein.

Non-conductive supporting member 36 has an internally threaded, longitudinally extending opening 38 therein with an integral, radially extending flange 40 adapted to nest within and being appropriately secured to nesting recess 42 formed within the terminal 26. Movable conductor 44 is disposed within housing 12 and has its threaded upper end 46 screwed into supporting member 36 and its lower end 48 extending into well 16. Contact member or washer portion 51 is integral with conductor 44 and radially extends therefrom at approximately its mid-portion. The topside of conductor 44 has a slot 45 adapted to receive the head of a screw-driver or other like tool.

Tubular well member 50 has a lower, solid, continuous section 52 adapted to be tightly received within well 16 of housing 12 and an upper, flared, continuous portion 54, with two struts 56 interconnecting such portions, thereby providing openings 58 within well member 50.

Tubular shield member 60 has a lower, solid, continuous section 62 and an upper radially extending washer portion 64 interconnected by struts 66, thereby providing openings 68 within shield member 60. The washer portion 64 is secured to contact member 51 along the periphery thereof. The outside diameter of section 62 is substantially equal to the inside diameter of well member 50, while the outside diameter of washer portion 64 is substantially equal to the inside diameter of the cavity 14 formed in housing 12.

Conductor 44, terminals 22 and 26 can be made from any suitable conductive material, while the remaining members are made from suitable insulating materials such as highly temperature resistant plastic, such as polyethylene.

FIG. 2 illustrates the switch in assembled form which includes a pool of mercury and the theft prevention feature of the switch. If the switch is used as an impact switch, the conductive washer portion 51 engages contact 30. In its normal state, a pool of mercury is disposed in well 16 within the lower section 52 of well member 50. Since the lower section 62 of shield member 60 is so located as to close off openings 58, the pool of mercury is contained within the entire well member 50 and can only move out of well 16 by slopping over the top of flared portion 54. Normally, an electrical connection is provided through the switch from terminal 22, through the pool of mercury, through conductor 44 immersed in such pool, through washer portion 51 of conductor 44, through contact 30 of terminal 26.

Upon being subjected to a predetermined impact, the mercury slops or pours out of well 16 into cavity 14, and then collects within the lower end of cavity 14, if and when switch 10 is returned to an up-right position. Since openings 58 are sealed off, the mercury cannot return to well 16 and the switch remains open.

In order to reset the switch, conductor 44 is first screwed downwards, separating contact 30 from washer portion 51, while moving section 62 downwards into well 16, thereby uncovering openings 58 and allowing the mercury to flow into well 16. Conductor 44 is then screwed in a reverse direction, moving conductor 44 upwards along with carried shield member 60, causing section 62 to again close off openings 58 in well member 50, and enabling the mercury to connect terminal 22 to conductor 44. Contact 30 is likewise connected to washer portion 51 completing the circuit.

If the switch were in a normal conductive position in an auto and one desired to easily open the switch, all that need be done is to rotate conductor 44 about one-half turn, which will disconnect contact 30 from washer portion 51, thereby opening the switch. This is an obviously desireable theft-prevention feature for use when a car is unattended. Simple counter-rotation of conductor 44 will connect contact 30 and washer portion 51 to close the switch.

Figure 4:
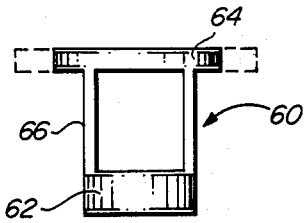
FIG. 4 is a side view of an alternative tubular member which can be used in the switch.
Figure 5:
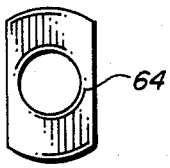
FIG. 5 is a top view of the member shown in FIG. 4.

In practice, it has been found that even though there is a tight fit between the washer portion 64 and the inside walls of housing 12, after considerable use it is possible for some mercury to leak into the area above washer portion 64 and contact 30, thereby causing an imperfect connection therebetween. FIGS. 4 and 5 show an alternate embodiment of the configuration of shield member 60 which has opposed ends (shown by dotted lines in FIG. 4) cut off to thereby allow downward draining of mercury and prevention of entrapment of mercury in such space, to allow a positive connection between contact 30 and washer portion 64.

It should be noted that the specific amount of impact or tilting of switch 10 required to open the switch and maintain it opened is dependent upon the design configuration and dimension of the well member 50 and especially the flared portion 54, it being apparent that the angle of portion 54 is especially critical.

Various changes, alterations, modifications and additions can be made in the impact switch disclosed without departing from the scope and spirit of the invention described herein, it being the intent to have the invention limited only by the scope of the appended claims.

What is claimed is:

1. An impact switch assembly, comprising:

(a) a non-conductive housing having a cavity therein, (b) a first conductive terminal secured to said housing, (c) a second conductive terminal secured to said housing, (d) moveable terminal bridging means disposed in said cavity adapted to electrically interconnect said first and second terminals, comprising:

(1) a moveable electrical conductor secured to said housing and disposed in said cavity, (2) a pool of liquid mercury disposed in said cavity and adapted to electrically connect said second terminal with said conductor, (3) control means for moving said conductor into and out of electrical contact with said first terminal, (4) said conductor being positioned to allow the electrical connection of the first terminal and pool of mercury, (e) whereby an electrical circuit is completed between said terminals when the pool of mercury contacts the conductor and second terminal only when said conductor is in contact with said first terminal.

2. The impact switch assembly of claim 1, wherein said cavity has a well at the lower end thereof for receiving and accumulating said pool of mercury.

3. The impact switch assembly of claim 2, including shielding means for maintaining said mercury within said well during relatively minor movements of the switch assembly while preventing return of said mercury to said well after being displaced from said well by relatively major movements of the switch assembly.

4. The impact switch of claim 3 wherein said shielding means includes:

(a) a tubular well member secured within said well, having an upper flared portion and an opening in its wall portion, and (b) a movable, tubular shield member having shielding portions adapted to open and close the opening in the wall portion of the tubular well member, (c) whereby movement of the shield member into a position to close said opening enables the mercury to be maintained within said well during minor movement of the switch assembly, while preventing return of the mercury to said well after being displaced from said well by relatively major movements of the switch assembly, and (d) whereby movement of the shield member into a position to open said opening enables the return of mercury to the well after having been displaced therefrom.

5. The impact switch assembly of claim 4 wherein said shield member is secured to and carried by said conductor.

6. The impact switch assembly of claim 4 wherein said control means simultaneously (1) moves the conductor into and out of electrical contact with said first terminal, and (2) moves the shield member so as to respectfully cover and uncover the opening in the well member.

7. The impact switch assembly of claim 6 wherein said control means includes:

(1) an internally threaded, non-conductive tubular supporting member adapted to receive a threaded extension portion of the conductor, (2) wherein the first terminal has a longitudinally extending opening therein, and the supporting member is nested within such opening.

8. The impact switch of claim 7 wherein said shield member has a radially extending washer portion secured to the upper end thereof, whose periphery closely fits within and contacts the walls of said cavity to prevent the mercury from electrically connecting the conductor and the first terminal.

9. The impact switch assembly of claim 7 wherein said shield member has a radially extending washer-like portion secured to the upper end thereof, with only part of its periphery contacting the walls of said cavity, whereby the mercury is prevented from electrically bridging the gap between the conductor and the first terminal while preventing entrapment of mercury between the washer-like portion and top of the cavity.

10. The impact switch assembly of claim 4 wherein said well member has a plurality of openings in its wall portion.

11. The impact switch assembly of claim 4 wherein said shield member has at least one opening in its wall portion to allow egress of the mercury from said well upon relatively violent agitation of the switch assembly.

12. The impact switch of claim 11 including a contact member integral with said conductor which is used to connect the first terminal and the conductor.

13. The impact switch of claim 12, wherein said shield member is secured to and carried by the conductor.

* * * * *